US006768502B2

(12) United States Patent
Milton

(10) Patent No.: US 6,768,502 B2
(45) Date of Patent: Jul. 27, 2004

(54) LABEL PRINTER DOT LINE REGISTRATION ASSEMBLY

(75) Inventor: Scott C. Milton, Maplewood, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 172 days.

(21) Appl. No.: 09/683,715

(22) Filed: Feb. 6, 2002

(65) Prior Publication Data

US 2003/0146968 A1 Aug. 7, 2003

(51) Int. Cl.[7] ..... B41J 25/304
(52) U.S. Cl. ..... 347/197
(58) Field of Search ..... 347/197, 198, 347/193; 400/120.16, 120.17, 120.13, 120.02

(56) References Cited

U.S. PATENT DOCUMENTS

| | | | | |
|---|---|---|---|---|
| 5,078,523 A | | 1/1992 | McGourty et al. | 400/613 |
| 5,138,341 A | | 8/1992 | Kobayashi | 346/136 |
| 5,157,761 A | | 10/1992 | Hawkes | 395/107 |
| 5,163,675 A | | 11/1992 | Sunohara | 271/274 |
| 5,188,009 A | | 2/1993 | Sunohara et al. | 83/13 |
| 5,202,958 A | | 4/1993 | Kobayashi | 395/102 |
| 5,275,077 A | | 1/1994 | Kobayashi | 83/880 |
| 5,318,370 A | | 6/1994 | Nehowig | 400/613 |
| 5,511,891 A | | 4/1996 | Nehowig et al. | 400/583 |
| 5,638,106 A | * | 6/1997 | Nierescher | 347/198 |
| 5,678,938 A | * | 10/1997 | Saito et al. | 400/120.17 |
| 5,755,519 A | | 5/1998 | Klinefelter | 400/249 |
| 5,823,689 A | | 10/1998 | Nehowig et al. | 400/83 |
| 5,823,692 A | | 10/1998 | Tolrud et al. | 400/582 |

(List continued on next page.)

OTHER PUBLICATIONS

U.S. patent application Ser. No. 09/683,714, pending, filed Feb. 6, 2002.

(List continued on next page.)

*Primary Examiner*—Lamson Nguyen
*Assistant Examiner*—K. Feggins
(74) *Attorney, Agent, or Firm*—Whyte Hirschboeck Dudek SC

(57) ABSTRACT

A label printer registration assembly for use in a label printer is disclosed. The registration assembly includes: a registration device securable to a base portion frame of the label printer, and a print head assembly mountable to a cover portion frame of the label printer. The print head assembly further includes: a variably loadable print head for printing to a variety of label media types and sizes; and a registration face attached to the print head. The registration face is engageable with the registration device to maintain registration between the print head and the registration device. The print head is variably loadable to a media-specific load. The print head can also be unloaded while the print head and registration roller are engaged so as to achieve and maintain an unloaded registration. The invention also includes a method for printing a dot line to a label media. The invention accomplishes printing in a manner that can accommodate adjustment or varying of the load that is applied to the label media according to the specific label media used.

31 Claims, 8 Drawing Sheets

U.S. PATENT DOCUMENTS

| | | | | | |
|---|---|---|---|---|---|
| 5,887,993 | A | | 3/1999 | Nunokawa et al. | 400/208 |
| 6,007,263 | A | | 12/1999 | Imai et al. | 400/693 |
| 6,008,831 | A | | 12/1999 | Nakanishi et al. | 347/195 |
| 6,034,705 | A | | 3/2000 | Tolle et al. | 347/195 |
| 6,042,279 | A | | 3/2000 | Ackley | 400/103 |
| 6,046,756 | A | | 4/2000 | Iga et al. | 347/173 |
| 6,046,757 | A | * | 4/2000 | Kanai | 347/197 |
| 6,061,076 | A | * | 5/2000 | Ishii et al. | 347/197 |
| 6,099,178 | A | | 8/2000 | Spurr et al. | 400/207 |
| 6,112,658 | A | | 9/2000 | Gunther et al. | 101/171 |
| 6,141,028 | A | * | 10/2000 | Aruga | 347/193 |
| 6,149,325 | A | | 11/2000 | Nunokawa et al. | 400/208 |
| 6,201,256 | B1 | | 3/2001 | Kouchi et al. | 250/559.44 |
| 6,213,659 | B1 | | 4/2001 | Elgee | 400/633 |
| 6,239,825 | B1 | * | 5/2001 | Kuwabara et al. | 347/197 |
| 6,246,050 | B1 | | 6/2001 | Tullis et al. | 250/231.13 |
| 6,249,302 | B1 | | 6/2001 | Sekiya | 347/220 |
| 6,264,296 | B1 | | 7/2001 | Klinefelter et al. | 347/4 |
| 6,264,774 | B1 | | 7/2001 | Lenz et al. | 156/64 |
| 6,266,075 | B1 | | 7/2001 | Feitel et al. | 347/198 |
| D446,544 | S | | 8/2001 | Platner et al. | D18/50 |
| 6,270,858 | B1 | | 8/2001 | Paulson | 427/508 |
| 6,276,849 | B1 | | 8/2001 | Feitel et al. | 400/242 |
| 6,390,697 | B1 | * | 5/2002 | O'Mera et al. | 400/120.16 |

OTHER PUBLICATIONS

Brochure— Brady® Make–It–Yourself Products, It's Important to use the Right Tool for the Right Job, Brady Worldwide, Inc., 1999.

Brochure— Brady® Graphic Solutions, GraphicsPro™ Label & Sign Creator Offers the Convenience of Custom Labels and Signs at the Touch of a Fingertip, W.H. Brady Co./Brady USA, Inc., 1997.

Brochure— Impressa 2 digital label & decal press, Print and Cut Your Own Full–Color Labels and Decals in any Size or Shape!, pp. 1–6, Primera Technology, Inc., 1998.

Brochure— ColorCamm Pro Versality, Roland DGA Corporation, 2000.

Brochure— The Future of Sign Making is here, Gerber Edge, Gerber Scientific Products, Inc., 1994.

* cited by examiner

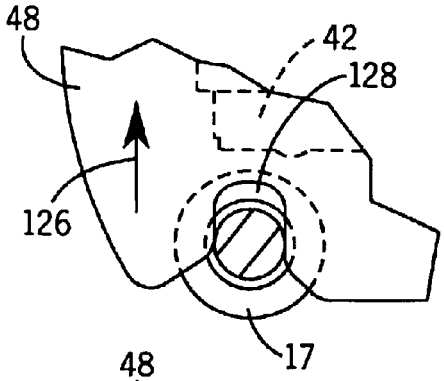
FIG. 12b
FIG. 12a
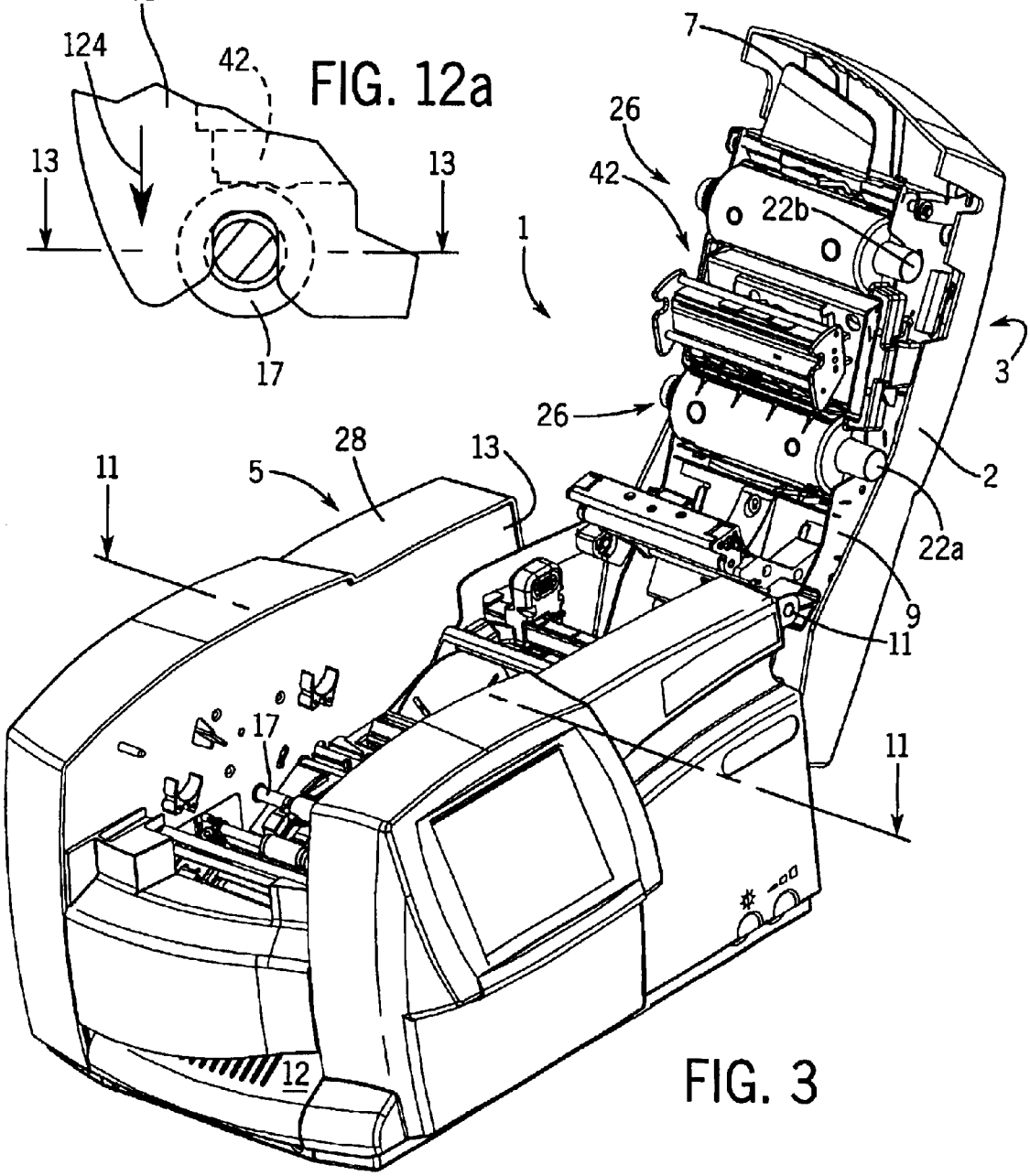
FIG. 3

LABEL PRINTER DOT LINE REGISTRATION ASSEMBLY

FIELD OF THE INVENTION

The present invention relates generally to printing to a label media using a label printer. In one aspect, the invention relates to a label printer that includes a registration assembly for registering a print head to a registration device. In another aspect, the invention relates to a method for printing a dot line to a label media using the registration assembly.

BACKGROUND OF THE INVENTION

Electronic label printing machines are often used to generate adhesive labels having images (e.g., indicia, graphics, art, specialized instructions, warnings, slogans, advertising, etc.) to facilitate identification, tracking and pricing of goods. Such label printers typically include: a print head, an assembly (e.g., a label media cartridge) for conveniently supplying or inserting a label media (also called a label media supply) into the printer so that the label media can be fed past the print head in order to be printed, a microprocessor, a read-only memory (ROM) programmed with appropriate instructions therein to operate the microprocessor, a random access memory (RAM), a keyboard with letter, number, and function keys for entry of alphanumeric information requisite to printing the indicia on the label media, and a visual display such as a light emitting diode ("LED") or liquid crystal display ("LCD") screen to convey information to a machine operator. These components function together to achieve the end goal of creating high quality and accurate labels from the label media using the electronic label printing machine.

Labels are made from a label media. The label media itself typically is made up of a roll of pressure sensitive tape that is attached, typically along a side containing an adhesive, to a continuous support roll of release liner material. The label media is fed in a media direction along a media path through the label printer. Discrete labels are formed by cutting the label media. Complex label shapes can be obtained by plotter cutting the tape layer only of the label media. The label media can be end cut (i.e., cutting through the tape and the release liner layers) or portioned into an end cut label media portion in order to obtain as many discrete labels in a continuous row as is desired. In other words, one or more than one discrete label can reside on an end cut label media portion. An end cutting operation can occur with or without a plotter cutting operation first having taken place. Following label media cutting, the discrete labels can be removed from the release liner and attached, as appropriate, to the particular application requiring identification. Since there are many types of label applications, there are many combinations of tape and release liners that can provide labels of varying sizes, colors, formats, and characteristics.

One type of label printer employs a thermal transfer print head. In general, the use of thermal print heads in label printers has increased as the quality and accuracy of thermal print heads has improved. Thermal transfer printing uses a heat-generating print head to transfer ink, or the like, from a thermal transfer ribbon to a label media to form a label image on the media. A microprocessor determines a sequence of individual thermal, typically resistive, print head elements to be selectively heated or energized. Energizing the sequence of elements in turn heats the ribbon so as to transfer the ink from the ribbon, creating the desired image on the label media, and specifically, on the label tape.

The label printer can be fed label media from a label media source. Simultaneously, a thermal transfer ribbon can be fed from a ribbon source. While the label media runs between the print head and a support (platen) roller, the transfer ribbon can run between the print head and the support roller. Thus, the label media and the transfer ribbon can run together in an overlay relationship between the print head and the support roller.

When it is desired to print a color image on a label media, it is generally required to print the image by passing the label media several times past the print head. To accomplish each pass, the label media is fed, retracted, and then re-fed again past the thermal print head. With each pass, a different primary color, for example, in a traditional color scheme, cyan, magenta, yellow, and black, is printed from a continuous ink ribbon onto the label media using the print head. In this manner, based on the amount of each color printed, a composite color image can be printed onto a label media.

It is continually desirable to improve the functionality, performance and/or efficiency of various components, or combinations of components (also sometimes called "assemblies" or "subassemblies") that make up label printers. For example, it would be desirable to improve the process of cutting label media in label printers.

Thermal printing requires physical contact between the print head and, in particular, the thermal printing elements, and the label media for printing to occur. The physical contact results in a force being applied from the print head to the media. There are many varieties of label media that can be used. Each specific media requires a unique force in order to accomplish the requisite physical contact for appropriate printing to occur.

Not only is it necessary to apply the proper force of the print head to the media, but the force must be applied at the proper location for appropriate printing to occur. Therefore, registration, or proper alignment, between the print head and the label media is required. It is always desirable to accomplish this registration in as simple a manner (e.g., fewest parts or components) as possible. Contemporaneously, it is necessary to be able to accomplish this registration for all of the conditions (e.g., different label media types, different forces at which printing occurs for each specific label media type, and the like) encountered during printing.

Thus, it would be advantageous, especially in label printers designed for use with a variety of label media types, to be able to accomplish printing to a label media such that the printing is in registration, and moreover, in a manner that can accommodate adjustment or varying of the load that is applied to the label media according to the specific label media used. It would be further desirable if such printing were accomplished in an efficient and cost-effective manner.

SUMMARY OF INVENTION

The present invention generally provides a label printer dot line registration assembly that overcomes the aforementioned problems.

According to one aspect, provided herein is, in a label printer having a cover portion frame and a base portion frame, a label printer registration assembly comprising: a registration device securable to the base portion frame of the label printer, and a print head assembly mountable to the cover portion frame of the label printer, the print head assembly comprising: a variably loadable print head for printing to a label media; and a registration face attached to the print head; wherein the registration face is engageable with the registration device to maintain registration between the print head and the registration device.

According to another aspect, provided herein is a method of printing to a label media, the method comprising: providing a dot line registration assembly, the dot line registration assembly including: a registration roller securable to a base portion frame of a label printer; and a print head assembly mountable to a cover portion frame of the label printer, the print head assembly including: a variably loadable, thermal print head for printing the registered dot line to the label media; and registration face attached to the print head; engaging the registration face with the registration device so as to achieve and maintain dot line registration; loading the variably loadable print head to a label media-specific load to achieve loaded registration between the print head and the registration roller; and thermally printing, at the media-specific load, a dot line to the label media, using the print head.

Various other aspects, features, objects and advantages of the present invention will be made apparent from the following detailed description and the drawings.

BRIEF DESCRIPTION OF DRAWINGS

Preferred embodiments of the invention are described below with reference to the following drawings, which are provided for illustrative purposes only. The drawings illustrate a best mode presently contemplated for carrying out the invention.

In the drawings:

FIG. 3 is a perspective view of the label printer of FIG. 1 with a portion of the printer interior exposed;

FIGS. 12*a* and 12*b* are enlarged side views of a portion of the label printer registration assembly in registration according to the present invention.

DETAILED DESCRIPTION OF THE PREFERRED EMBODIMENT

In the following detailed description, references are made to the accompanying drawings which form a part of this application, and in which is shown by way of illustration specific embodiments in which the invention can be practiced. These embodiments are described in sufficient detail to enable those skilled in the art to practice the invention, and it is to be understood that other embodiments can be utilized and that various changes can be made without departing from the spirit and scope of the present invention. Moreover, in the detailed description, like numerals are employed to designate like parts throughout the same. Various items of equipment, such as fasteners, fittings, etc., in addition to various other elements and specific principles of their operation, are omitted to simplify the description. However, those skilled in the art will realize that such conventional equipment and principles of operation can be employed as desired.

Figure 1:
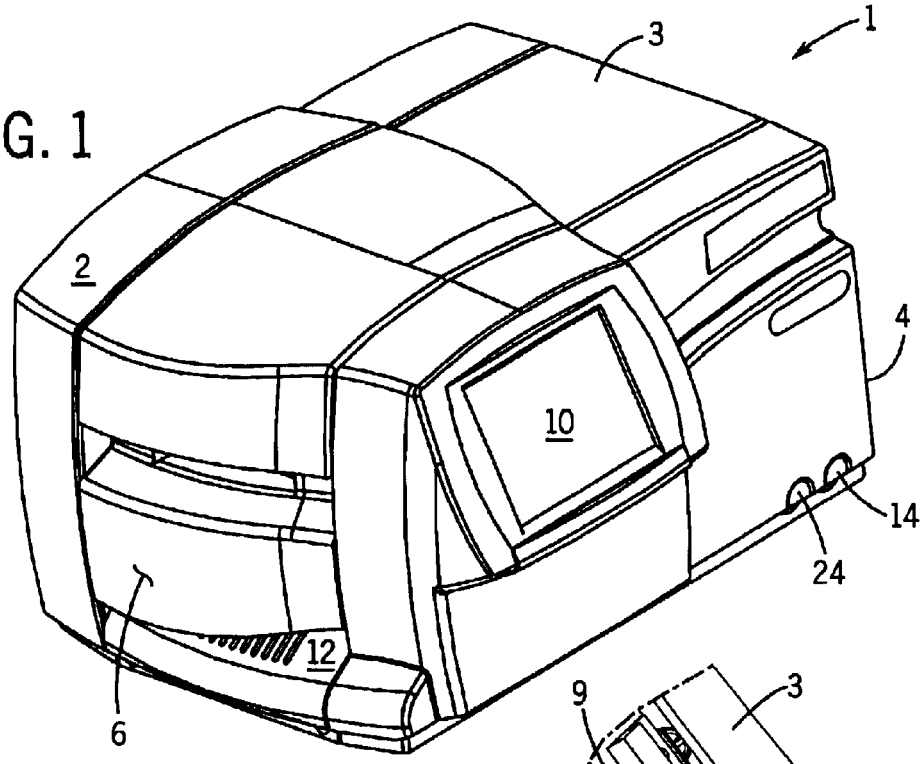
FIG. 1 is a perspective view of a label printer that can employ a label printer registration assembly according to one aspect of the present invention.

Shown in FIG. 1 is label printer 1. In a preferred embodiment, printer 1 can accomplish both printing and cutting operations in a single unit and thus, label printer 1 can also be referred to herein as a "label printer-cutter". Printer 1 includes a plastic housing 2 having a front 4, a back (not shown), a left side 6 and a right side (not shown). Printer 1 includes cover portion 3 and base portion 5 (FIG. 3). In FIG. 1, the cover portion is closed, and so printer 1 is shown in a configuration that is suitable for, for example, operation or transport.

Housing 2 supports an LCD screen 10 that can be pivotally mounted to housing front 4. Printed labels (not shown) are ejected from printer 1 via exit chute 12 formed in the housing side 6. LCD screen 10 can display, among other things, printer status and error indicators to a user of the printer. First adjustment mechanism 24 (FIG. 1) can be included, for example, to control and/or adjust LCD screen 10 brightness. Other parameters, such as print or color intensity of an output label, can also be adjusted, for example, by second adjustment mechanism 14.

Although not shown, it is contemplated that the printer 1 can be connected to, and usable with, a data entry device, such as keyboard, for entering alpha-numeric information necessary for preparation and design of a desired output. Printer 1 can include firmware (e.g., software designed on a platform such as Windows™ CE), available from Microsoft and software for controlling, in whole or in part, various printer assemblies, among them the registration assembly, described below.

As used in this application, to "register" means to align, so as to position in alignment, for example, one device, apparatus or assembly with respect to another and registration means to function, for example in a method of printing, so as to appropriately register.

Figure 2:
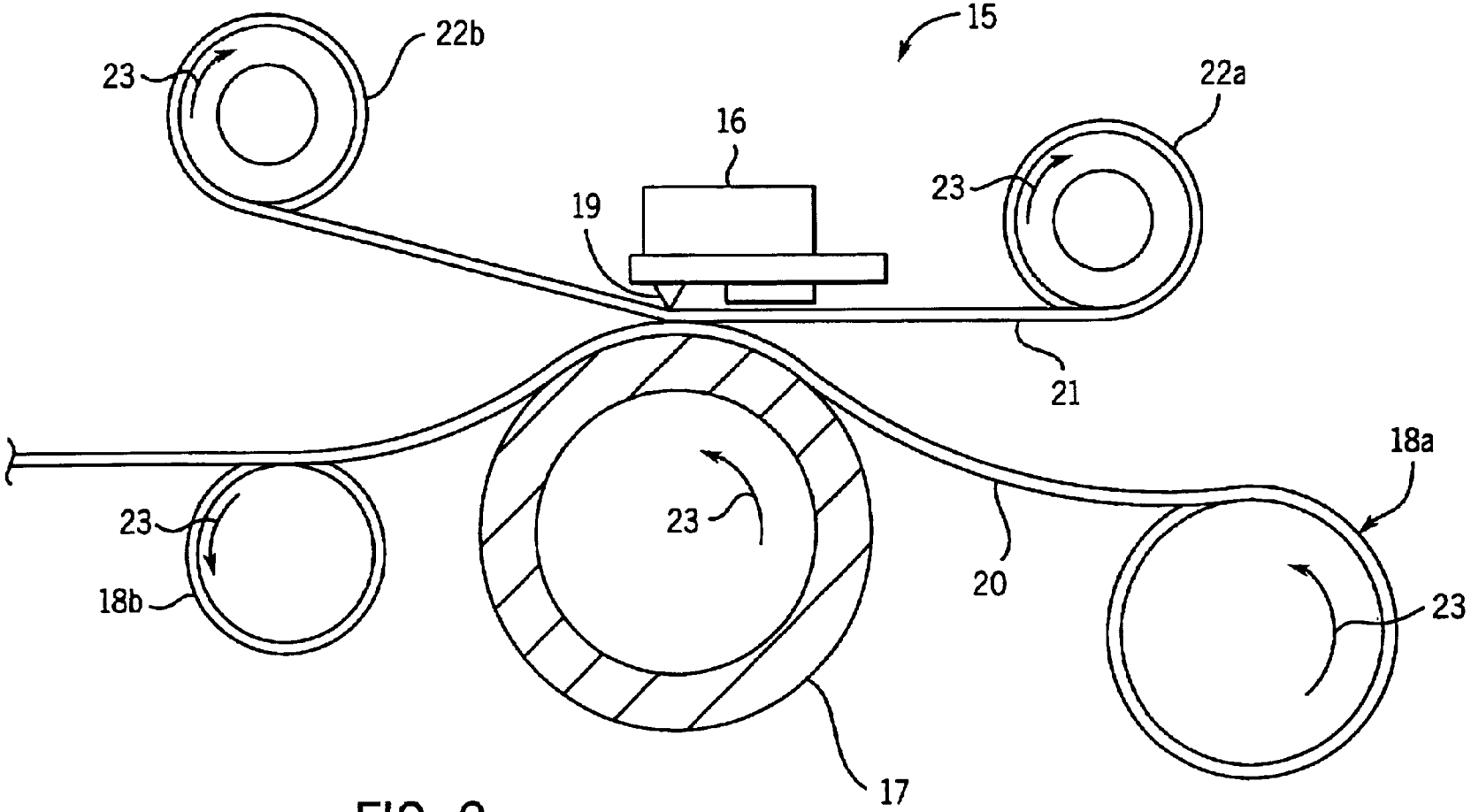
FIG. 2 is a schematic illustration of one embodiment of a printing arrangement that can be used with the label printer of FIG. 1.

A typical thermal printing arrangement 15 is illustrated schematically in FIG. 2 since, in a preferred embodiment, the label printer of FIG. 1 can be a thermal label printer. Printing arrangement 15 includes print head 16, support (platen) roller 17, label media delivery roller 18*a*, and label media take-up roller 18*b*. Label media delivery and take-up rollers 18*a,b* can be separate components, or alternatively, they can be housed within a unitary structure (e.g., a label media supply cartridge). Print head 16 is typically equipped with a linear array of thermal elements 19. The number of thermal elements 19 in the linear array can vary, with a characteristic print head 16 employing one thousand two hundred forty-eight (1,248) thermal elements 19. Thermal elements 19 produce heat in response to energy supplied to print head 16. A current is applied to thermal elements 19 to heat the thermal elements to a level sufficient to transfer dots onto label media 20. This occurs when a thermally-sensitive (e.g., an ink ribbon) supply 21 comes into thermal contact with thermal elements 19. Printing arrangement 15 includes thermally-sensitive supply delivery roller 22*a* and thermally-sensitive supply take-up roller 22*b*. Thermally-sensitive supply delivery and take-up rollers 22*a,b* can be separate components, or alternatively, they can be housed within a unitary structure (e.g., an ink ribbon cartridge). It is contemplated that color printing can be accomplished as well as black (along with shades of gray). Directional arrows 23 indicate the direction of travel of platen roller 17, label media delivery and take-up rollers 18*a,b* and thermally-sensitive supply delivery and take-up rollers 22*a,b* in printing arrangement 15. Other structures (e.g., a ceramic material layer) may be included in the printing arrangement between the print head and the label media to be printed. Thermal elements 19 transfer dots to label 20 in a line, called a "dot line".

Referring to FIG. 3, cover portion 3, having plastic cover 2 attached to cover portion frame 9, can be raised or opened to access the interior of printer 1, for example, when the printer is in an idle state, or when a label media is loaded. Cover portion 3 can be raised by releasing temporary securing mechanism 7 of cover portion 3 and applying a lifting force to the mechanism. Application of the lifting force causes cover portion 3 to pivot about a hinged attachment 11 of printer 1. Label printer 1 also includes a base portion 5 having a base portion frame 13 and plastic housing 28 attached thereto. Cover portion 3 further includes a print head assembly 42 mounted to cover portion frame 9. Base portion 5 includes label media support or platen roller 17 attached to base portion frame 13. As shown, a ribbon cartridge 26, used for holding and supplying a thermally sensitive ribbon (not shown), can be insertably attached to cover portion frame 9. Ribbon cartridge 26, as depicted in FIG. 3, comprises ribbon delivery roller 22*a* and ribbon take-up roller 22*b*. Ribbon supply roller 22*a* and ribbon take-up roller 22*b* can include gears (not shown) disposed on end of each roller. As ribbon supply roller 22*a* turns, the thermally-sensitive ink ribbon (not shown) is expelled and fed past print head assembly 42 and is wound upon ribbon take-up roller 22*b*. In applications in which color printing is desired, the ribbon can include or be divided into color panels or portions according to a known printing color scheme (e.g., cyan, magenta, yellow, and black) and the panels are fed past the print head to print one color at a time.

Figure 4:
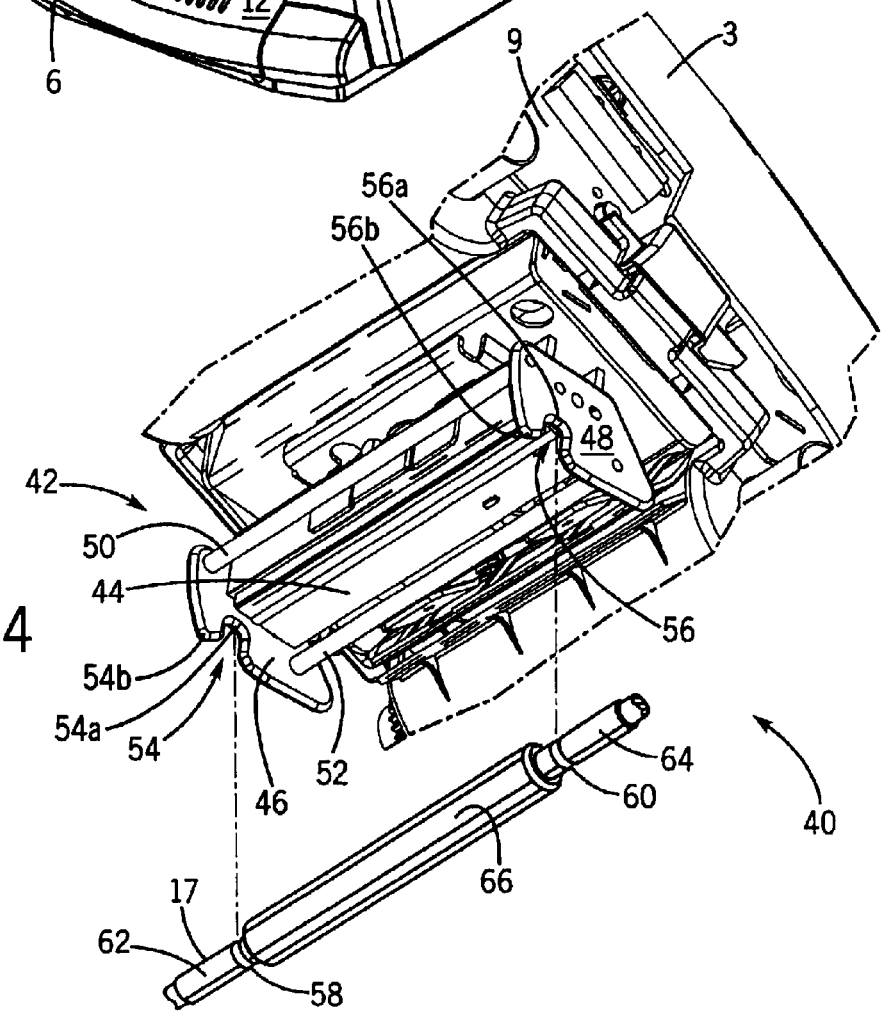
FIG. 4 shows an exploded perspective view of the label printer registration assembly according to one aspect of the present invention.

FIG. 4 illustrates an exploded perspective view of a label printer registration assembly 40. Registration assembly 40 includes a print head assembly 42 having a print head 44. Print head assembly 42 is mounted to cover portion frame 9 of cover portion 3. Print head assembly 42 includes a pair of opposing registration faces 46, 48, connected to print head 44. Roller guide bars 50 and 52, respectively, are disposed between registration faces 46 and 48 and proximate print head 44 to guide ink ribbon (not shown) past print head 44. Registration face 46 includes curved opening or notch 54. Notch 54 engages groove 58 in platen roller shaft portion 62 of platen roller 17. Similarly, registration face 48 includes curved opening or notch 56. Notch 56 engages groove 60 in platen roller shaft portion 64 of platen roller 17. Notches 54, 56 are shown to include substantially U-shaped portions 54*a*, 56*a* and widened portions 54*b*, 56*b*, respectively, which facilitate engagement with the of the platen roller. However any shape of notches 54, 56 that will facilitate engagement with platen roller 17 is contemplated. Alternative shapes can include, but are not limited to, square, polygonal or other contours. The fit between notches 54, 56 and platen roller 17 can be characterized as an locational fit. Platen roller 17 includes an elongated, cylindrical support portion 66 for supporting label media 20 (FIG. 2). In a preferred embodiment, platen roller 17 can be used to move the label media forward or backward. As such, support portion 66 can be made of a tacky and compliant material so as to reduce slippage and better guide the label media on the platen roller. In thermal printing, the material also serves to enhance ink transfer from the ink ribbon to the label media. One example of a material used on the platen roller is a black, silicone, rubber-like material by the name of 40 Durometer Shore A.

Any groove-opening arrangement that accomplishes registration between a moveable printer cover portion and a printer base portion so as to position the print head, and in particular the thermal elements of the print head, with respect to the label media so as to print a dot line in a desired location is contemplated to be within the scope of the present invention. In this manner, when the cover is lifted or lowered, contact is terminated or initiated between the groove of the platen roller and the openings of the print head assembly. Any mechanical coupling (e.g., male or female, snap-fit, tab-detent, etc.) is contemplated.

In a preferred embodiment, the label printer registration assembly comprises a thermal print head of the kind described above, namely, a print head that produces printed dots one line at a time (according to a desired sequence of print head elements that are fired). The registration assembly operates to ensure that each dot line is appropriately printed. Thus, in a preferred embodiment, the label printer registration assembly is referred to as a "label printer dot line registration assembly".

Platen roller 17 is generally termed herein a "registration roller". Because other arrangements are possible, and other rollers may serve to accomplish registration, it is understood that other rollers (e.g., passive or pinch, as well as active or driven rollers) can constitute registration rollers.

As shown and described earlier with respect to FIG. 2, the label media and ink ribbon pass in overlay relationship with each other. Platen roller 17 serves to register print head 44, and more particularly, thermal element 19 (FIG. 2) with respect to the label media and ink ribbon. This ensures that the dot line that is ultimately printed to a label media, which is supported by the platen roller, is printed at a desired location (i.e., proper spacing between printed lines, margins, and the like).

Various mechanical devices or assemblies besides rollers, can serve as registration devices. For example, other support structures, extensions from the printer base portion, and the like can be used as registration devices. In one embodiment, the registration device can be a shaft. Platen roller 17, a registration roller, can also be termed more generally as a registration device.

Referring generally to FIGS. 1–4, label printer assemblies (e.g., label printer registration assembly 40) and LCD display screen 10 are controlled by printer circuitry. Housing 2 of label printer 1 can be manufactured, along with its various assemblies, according to known manufacturing principles (e.g., injection molding) and using known materials (e.g., plastic, metal, and the like). Frame portions 3 or 9 can be designed to hold programmable memory devices known as flash cards that can be used to store firmware and software routines. Flash cards are typically used during product development to facilitate updates to the firmware and other software. Flash cards can be replaced by permanently programmed memory chips. Using the above described firmware and software and the associated memory devices, printer assemblies such as a registration assembly 40 can be activated and controlled in an automated fashion.

Figure 5:
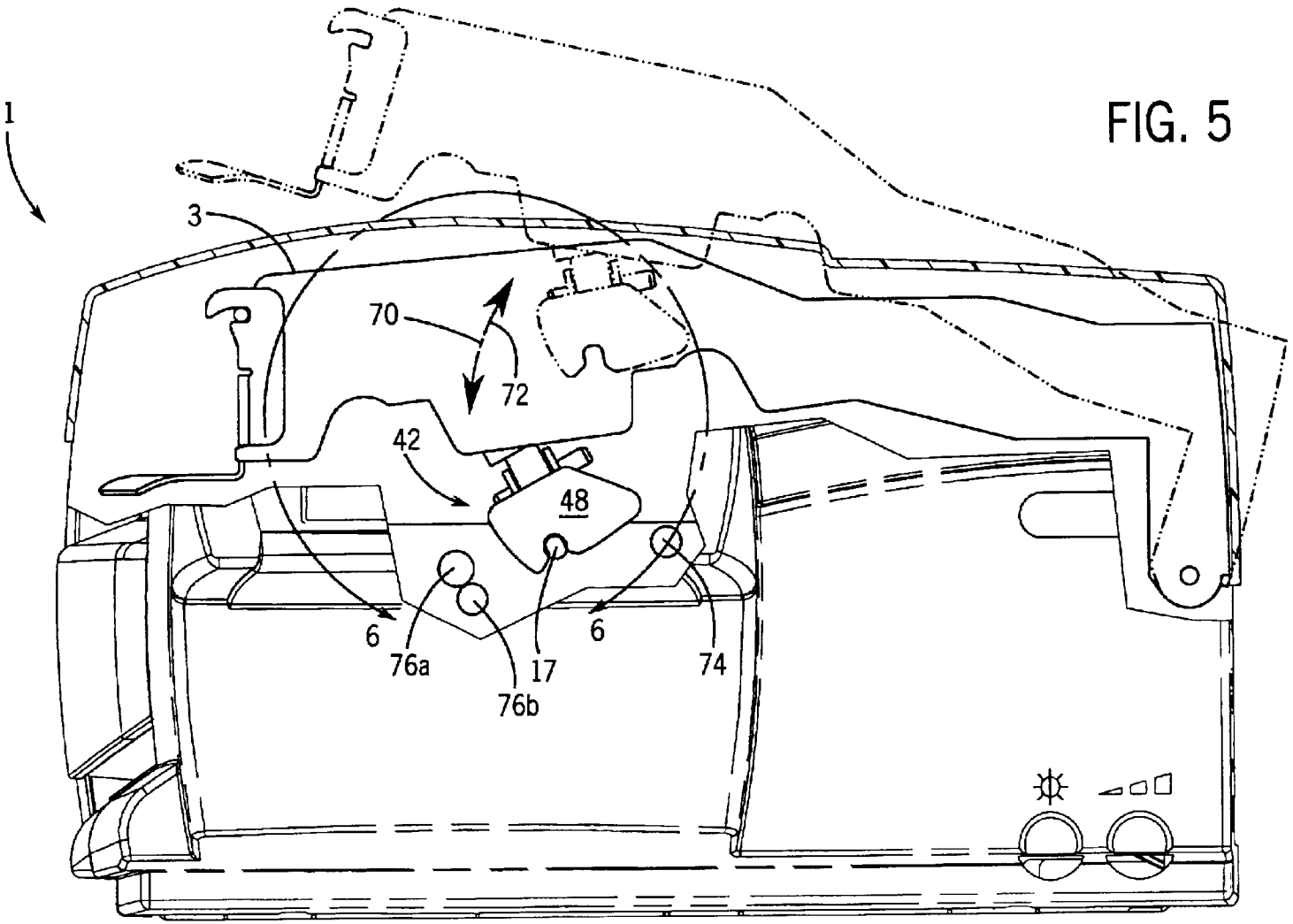
FIG. 5 shows a side cross-sectional view of the label printer of FIG. 1 illustrating the label printer registration assembly out of registration (shown in phantom) and in registration according to one aspect of the present invention.

Referring to FIG. 5, a side, cross-sectional view of label printer 1 is shown with print head assembly 42 in and out of (shown in phantom) registration. To achieve registration, print head assembly 42 engages, using registration faces 46 (not shown) and 48, platen roller 17. Print head assembly 42 is in registration when cover portion 3 of label printer 1 is in a closed position. As shown in phantom, print head assembly 42 is out of registration when cover portion 3 of label printer 1 is in an open position. Arrows 70, 72 are included to illustrate movement of the cover portion between open and closed positions. Encoder roller shaft 74 is also shown. Encoder roller shaft 74 works in conjunction with an encoder to measure or meter the amount of label media that has passed a given point. Such metering facilitates accurate printing, particularly in multicolor printing applications. Rollers 76*a,b* are also shown and are described in greater detail below in conjunction with FIG. 11.

Figure 6:
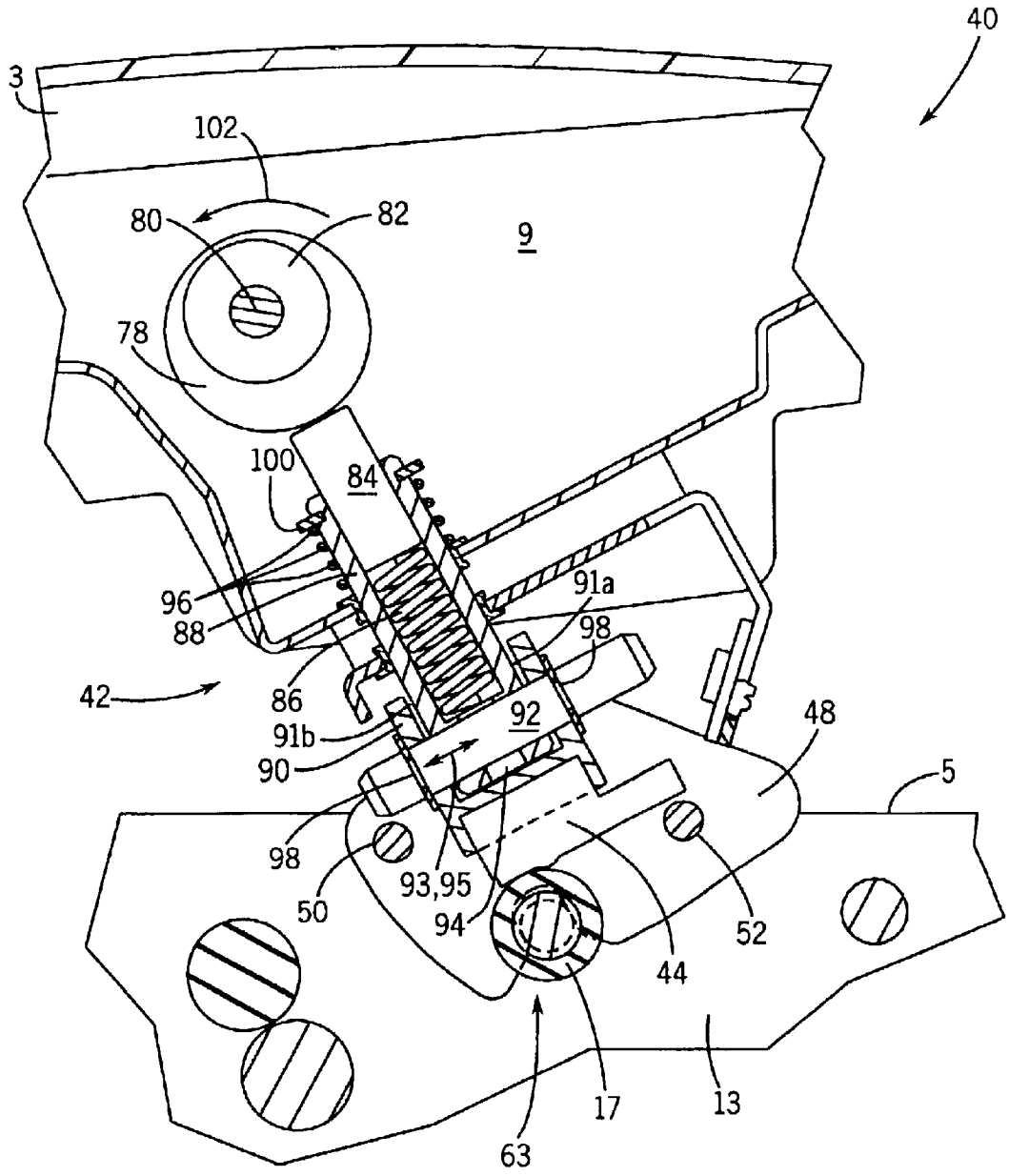
FIG. 6 shows an enlarged, detail, cross sectional view of the label printer registration assembly taken along line 6—6 of FIG. 5 according to one aspect of the present invention.

FIG. 6 shows an enlarged cross-sectional view of label printer registration assembly 40. Registration assembly 40 includes print head assembly 42, which is mounted to cover portion frame 9 of cover portion 3. Registration assembly 40 further includes platen roller 17, which is secured to base portion frame 13 of base portion 5. Print head assembly 42 includes a print head lift cam 78 (also called an "offset cylinder") attached to cover portion frame 9. Lift cam 78 is secured to shaft 80 using fasteners, such as bushing 82. A driving mechanism, for example a step motor (not shown), can be used to drive movement of shaft 80, which in turn rotates cam 78. Cam 78 rotatably contacts rod or follower 84, and the rod contacts, so as to alternatively compress, or permit extension of, print head load spring 86. Cam 78 is in operable association with spring 86, which is housed by print head assembly pin 88. Pin 88 is connected to print head 44 via print head mount 90. Registration face 48 is shown connected to print head assembly 42 by print head mount 90 and ribbon guide bars 50 and 52. Platen roller 17 is shown secured to base portion frame 5. Platen roller 17 and registration face 48 are shown to be engaged, or in registration. Retraction spring 96, connected to print head mount assembly pin 88 is included to facilitate retraction upwardly of print head assembly 42. Print head pivot pin 92 passes through, so as to pivotally connect, print head mount assembly pin 88 and print head mount 90. A movement-permitting clearance or space 94 also exists between mount 90 and print head 44. Clearances 91*a* and 91*b* allow movement of the print head assembly in directions corresponding to arrows 93, 95, to ensure that notches 54, 56 will appropriately align with platen roller 17. Print head pivot pin 92 can be secured into place via first rotation-permitting mechanism (e.g., an "e-ring") 98. Second rotation-permitting mechanism (e.g., an "e-ring") 100 is also included. First and second rotation-permitting mechanisms permit rotational adjustability of the print head assembly.

In order to actuate movement of print head assembly 42, cam 78 rotates or turns, for example, in a direction corresponding to arrow 102. Rotation is imparted via shaft 80, which can be connected to a gear train that is driven, for example, by a step motor. Cam 78, as it rotates, contacts and drives cam follower or plunger 84 downwardly, so as to compress primary print head load spring 86, which is housed by print head assembly pin 88. Spring 86 connects at its bottom to print head mount 90, which is connected to print head 44. In this manner, load (also referred to as pressure or force) is transferred to print head 44 so as to place print head 44. The print head is typically loaded for and during printing to the label media. The print head generally remains loaded whenever the label media is advanced or retracted in label printer.

During ink ribbon advancement (e.g., when one color of a traditional color scheme such as cyan, magenta, yellow, and black has been printed and the next color is to be printed), it is desirable for printing not to occur, and yet maintain registration between the print head and the platen roller. To accomplish this result, the print head is preferably unloaded so that no load, or substantially no load, is transferred to the label media, thereby achieving unloaded registration. Here, cam 78 is again rotated as before, for example, in a direction corresponding to arrow 102. Now, rotation of cam 78 causes follower to move upwardly, which permits primary print head load spring 86 to extend since the load imparted on spring 86 has been released. With the load removed, return or retraction spring 96 functions to raise print head assembly 42, and thus print head 44, upwardly so that there is a clearance or space between print head 44 and platen roller 17. In this manner, when the print head is unloaded, ink ribbon can be advanced as desired while the label media remains stationary. The print head can be unloaded in other instances, for example, when performing associated cutting operations to the label media (e.g., in a cutting assembly also located in the label printer), or when changing ink ribbon cartridges. In general, the print head is typically unloaded when printing to label media is not taking place (e.g., when the ink ribbon is advanced from one color to the next color in a multi-color print job).

Thus, in order to accomplish thermal printing, in addition to applying heat to the thermally-sensitive ribbon, it is also necessary to apply a load (also called a pressure or force herein) against the ribbon. A force is applied to the ribbon via the print head, and specifically the thermal elements, for example thermal elements 19 of FIG. 2. Therefore, physical contact must exist between the print head and the label media, in combination with the ink ribbon and the heated thermal elements, to effect printing. Because of variations in the media supply used (e.g., material type, thickness, and the like), each media will require a unique force in order to accomplish the requisite physical contact for printing to occur. Typical label media materials include polyester film, vinyl film, and polypropylene film, among others, and typical forces associated with these media range from about 10 to about 17 pounds force.

Accordingly, in a preferred embodiment, the load that is applied or transferred to the label media via the print head can be varied to accommodate, for example, the appropriate load for the specific label media used (i.e., a media-specific load). Thus, the print head can be called a "variably loaded" print head, or can be considered to be "variably loadable". It shall be understood that the terms "variably loaded" and "variably loadable" have been used to describe the print head for convenience only, as the terms can also be used to modify or otherwise describe, for example, the print head assembly, or other printer components associated with the print head. Moreover, it shall be understood that the load applied by the print head can be varied according to other parameters, such as, for example, the specific ribbon type or ink type that utilized. In short, the terms "variably loaded" and "variably loadable" are to be interpreted to include varying the print head load applied during label printing according to any number of label-printing related parameters.

As noted above, the print head can be variably loaded to accommodate the desired media-specific loads. Media-specific loads can be determined in a variety of ways, but are often determined in a fashion that can be characterized as iterative or intensive trial and error. In a preferred embodiment, specific loads are determined for a variety of desired label media using empirical testing techniques. These loads, or values representative of the loads, can then be stored in a memory (e.g., a chip, smart cell, etc.) that can be attached, or located proximate, to a label media, for example, on label media supply cartridge, such as the one shown in FIG. 3. A label printer microprocessor can read the label media supply-specific load values from the memory, for example, when the label media cartridge having the memory device attached thereto is inserted into the label printer. Position slots or notches corresponding to the desired, media-specific load(s) can be included on, or otherwise formed in, the print head lift cam mechanism. With the load value(s) having been read by the printer microprocessor, appropriate printer circuitry can be used to drive the print head cam to the appropriate cam position slot. As a result, the print head is loaded according to the supply-specific load.

Figure 7:
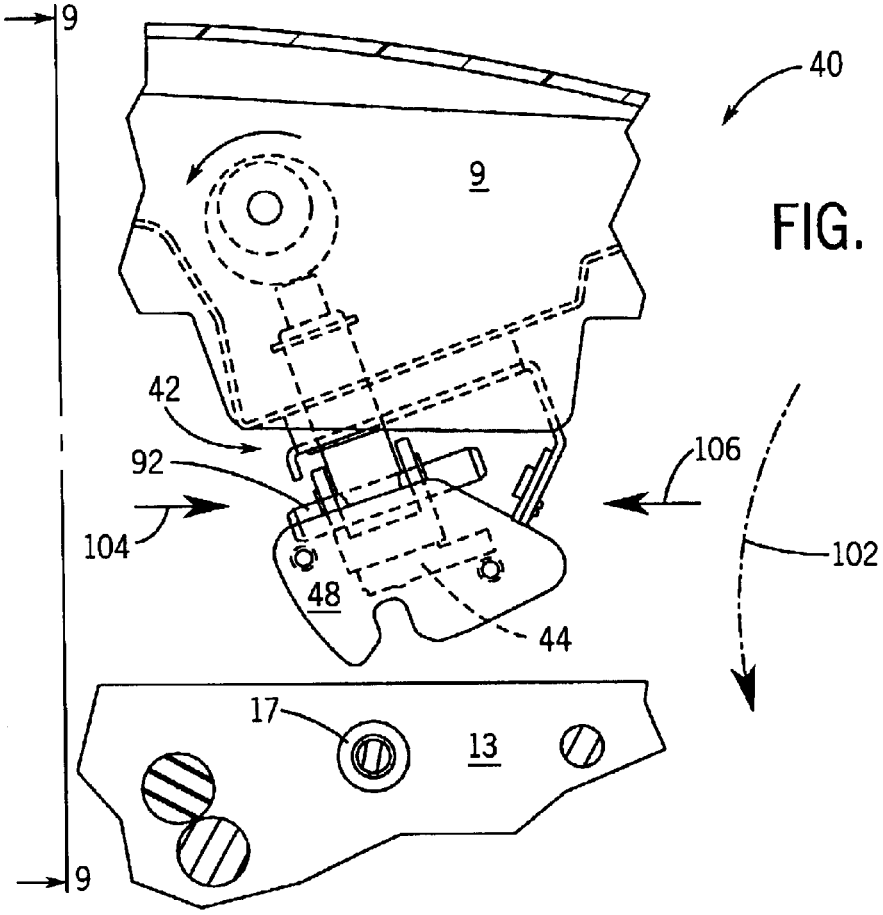
FIG. 7 shows a cross sectional view similar to that of FIG. 6 showing the label printer registration assembly out of registration according to one aspect of the present invention.
Figure 9:
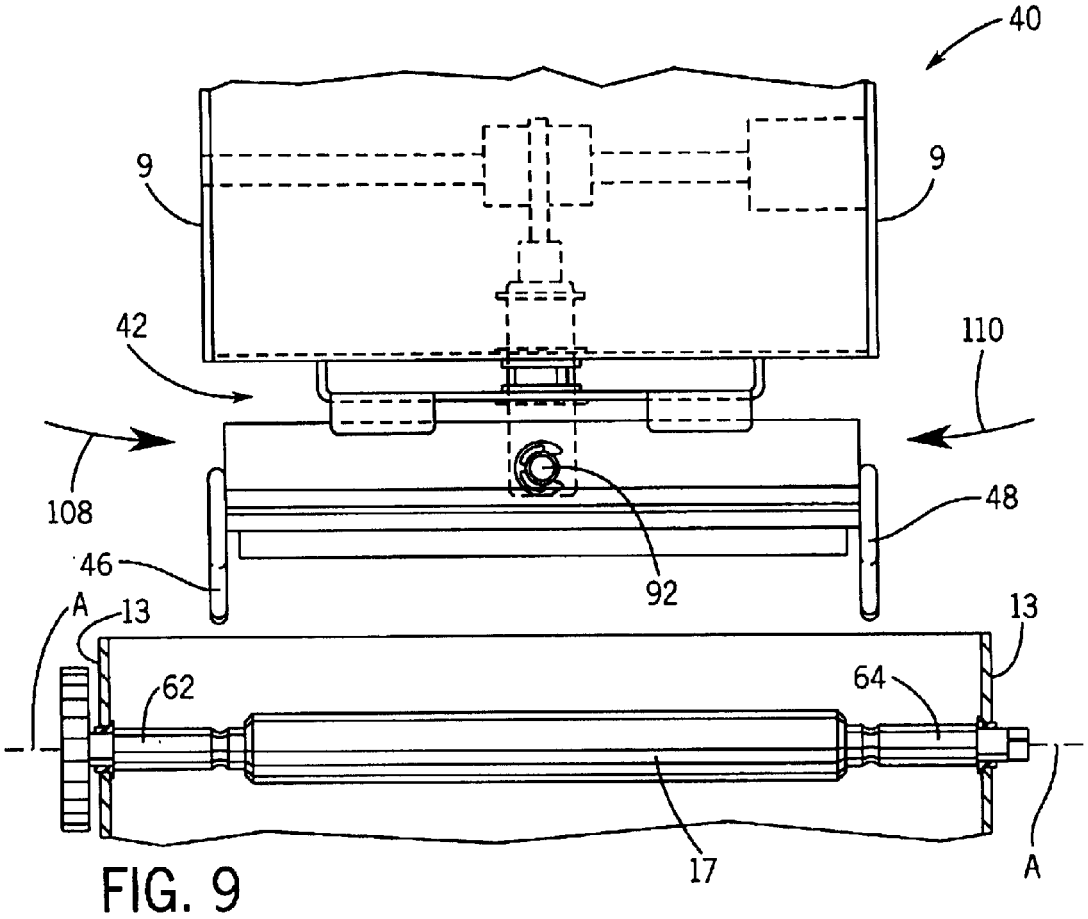
FIG. 9 shows a partial front, partial cross sectional view taken along line 9—9 of FIG. 7 showing the label printer registration assembly out of registration according to one aspect of the present invention.

FIGS. 7 and 9 show cross sectional views of label printer registration assembly 40 with registration faces 46 (FIG. 9) and 48 disengaged from platen roller 17, which is attached to base portion frame 13. Platen roller 17 can rotate about axis A. Cover portion frame 9, to which print head assembly 42 is attached, can be moved downwardly, as indicated by dashed arrow 102. When registration assembly 40 is disengaged from platen roller 17, print head pivot pin 92 permits, in conjunction with motion permitting space or clearance 94 (FIG. 6), print head assembly 42 to move transversely, or substantially transversely, with respect to axis A of platen roller 17. Transverse movement of print head assembly 42 is indicated by arrows 104 and 106 (FIG. 7). Further, as shown in FIG. 9, when print head assembly 42 is disengaged from platen roller 17, print head pivot pin 92 permits the print head assembly to move axially with respect to axis A of the platen roller, with such axial movement indicated by arrows 108 and 110.

Figure 8:
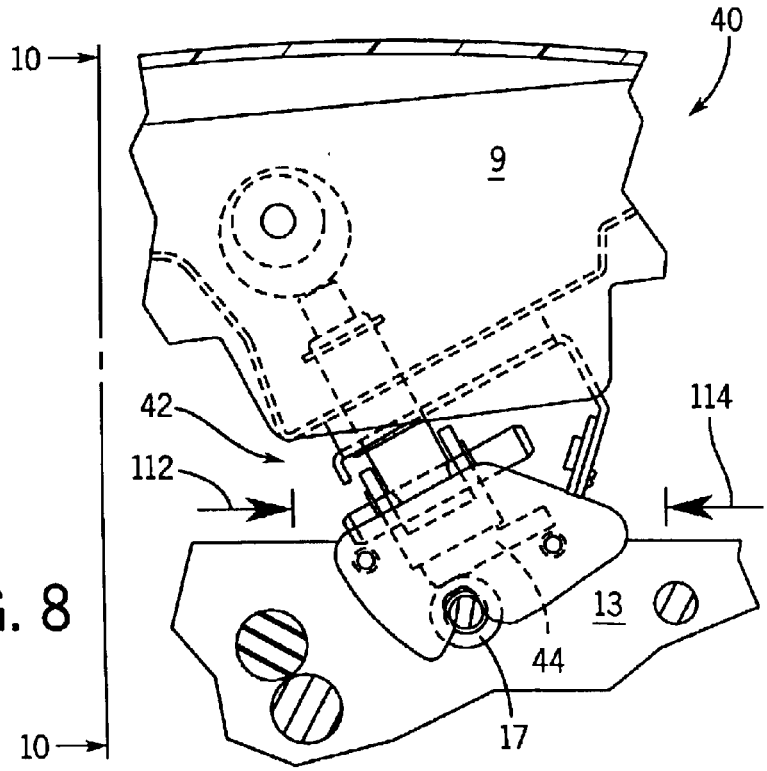
FIG. 8 shows a cross sectional view similar to that of FIG. 7 showing the label printer registration assembly in registration according to one aspect of the present invention.
Figure 10:
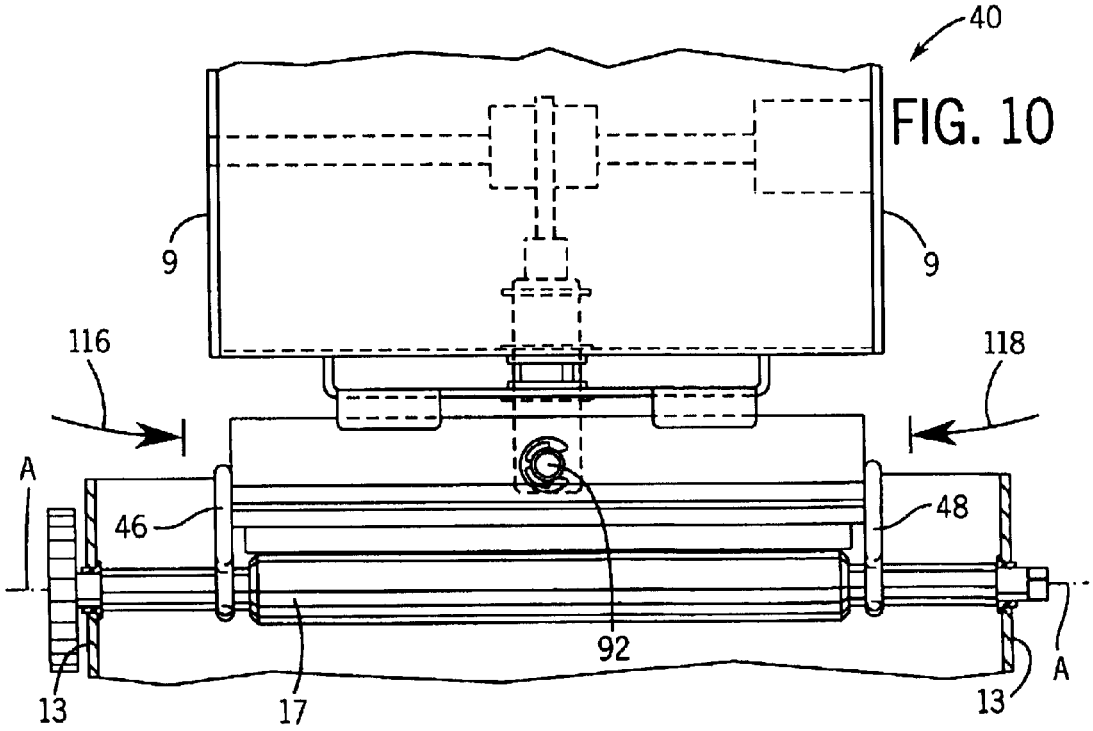
FIG. 10 shows a partial front, partial cross sectional view taken along line 9—9 of FIG. 8 showing the label printer registration assembly in registration according to one aspect of the present invention.

FIGS. 8 and 10 show cross sectional views of label printer registration assembly 40, comprising print head 44, connected to cover portion frame 9, engaged with platen roller 17, which is secured to base portion frame 13, via registration faces 46 (FIG. 10) and 48. As such, the print head is in registration with respect to the platen roller such that appropriate printing to the label media can occur. When in registration, print head 44 is prevented or substantially prevented, from moving transversely, or substantially transversely, with respect to axis A of platen roller 17 (FIG. 9). One such transverse movement is as indicated by arrows with bars 112 and 114 (FIG. 8). Also, when in registration, print head 44 is prevented or substantially prevented, as indicated by arrows with bars 116 and 118 (FIG. 10), from moving axially with respect to axis A of platen roller 17 (FIG. 10). As used herein, "substantially prevented" does not mean preventing motion that occurs due to driving of the print head by the print head assembly components described previously (e.g., the lift cam, the spring, etc.) For example, during printing, driving of the print head to achieve a media specific load is not prevented or constrained.

Figure 11:
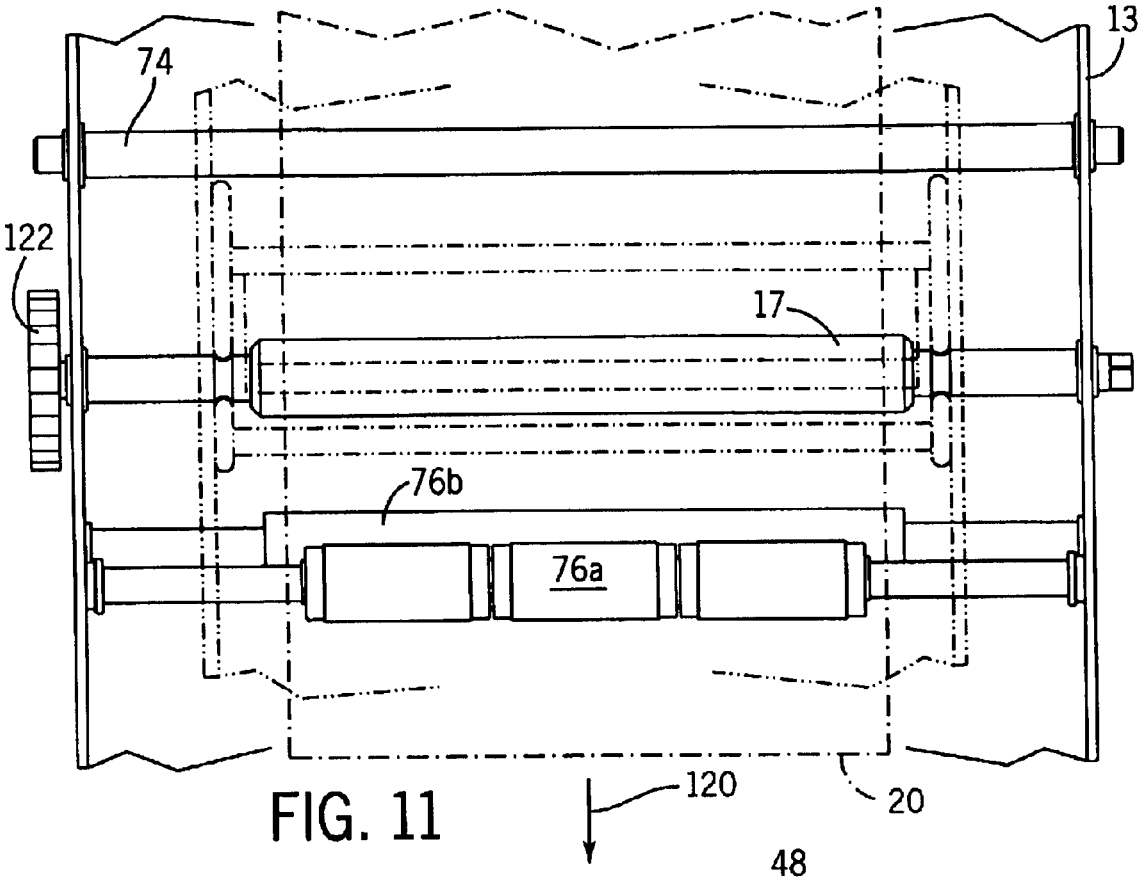
FIG. 11 shows an enlarged top view taken along line 11—11 of FIG. 3 showing a portion of the label printer registration assembly according to one aspect of the present invention.

FIG. 11 shows an enlarged, top view of a portion of the print head assembly taken along line 11—11 of FIG. 3 according to one aspect of the present invention. Label media 20 can be fed in a label media direction, indicated by arrow 120 past platen roller 17, which is connected to base portion frame 13. In a preferred embodiment, as shown, platen roller 17 serves not only as a support roller for label media 20, but also serves, at least in part, to drive or feed the label media past print head 44 (FIG. 6). Platen roller 17, as shown, is connected to a gear mechanism 122, and it is via the gear mechanism that the platen roller can be driven by, for example, a step motor shown). Located upstream (i.e., in a direction opposite label media direction 120) of platen roller 17 is encoder roller 74, described previously.

Still referring to FIG. 11, located downstream of platen roller 17, are a pair of rollers 76*a,b*. It is contemplated that rollers 76*a,b* can be pinch or passive rollers, driven or drive rollers (i.e., rollers connected to, and driven by, for example, a step motor), or a passive/driven roller combination. It is further contemplated that, while not illustrated, rollers 76*a,b* can be connected to, or components of, a separate or self-contained label printer cutting assembly. In this manner, rollers 76*a,b* can be termed cutting assembly rollers.

FIG. 12*a* illustrates an enlarged cross sectional view of a portion of label printer registration assembly 40. Print head 44 (shown in phantom) is driven downwardly, indicated by arrow 124, such that it is shown in a loaded position. Registration face attached to print head assembly 42, is shown engaged to platen roller 17. Registration assembly 40 can be said to be in "loaded registration".

FIG. 12*b* illustrates an enlarged cross sectional view of a portion of label printer registration assembly 40. Print head 44 (shown in phantom) is driven upwardly, indicated by arrow 126, such that it is shown in an unloaded position. Registration face 48, attached to print head assembly 42, still engages platen roller 17. However, there is a gap 128 between face 48 and platen roller 17. Registration assembly 40 can be said to be in "unloaded registration". Alternatively, registration assembly 40 can be considered to be shown in "loaded registration" in FIG. 12*b* when the registration assembly is used with a different, thicker, label media (not shown), as compared to FIG. 12*a*.

Figure 13:
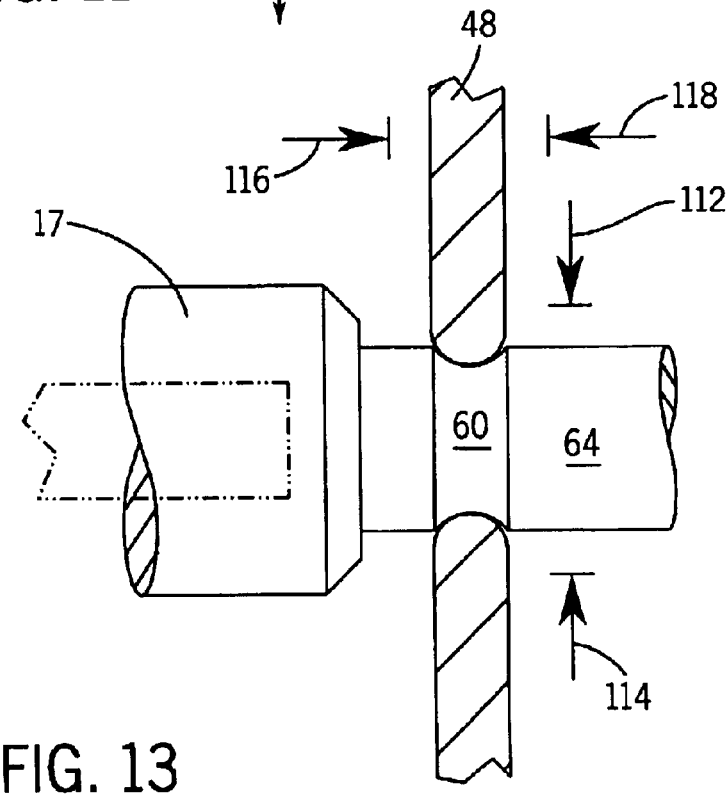
FIG. 13 is an enlarged cross-sectional view taken along line 13—13 of FIG. 12*a* showing a portion of the label printer registration assembly in registration according to one aspect of the present invention.

FIG. 13 is an enlarged cross-sectional view taken along line 13—13 of FIG. 12*a*. Specifically, FIG. 13 illustrates registration face 48 engaging groove 60 of shaft portion 64 of platen roller 17, thereby positioning the label printer registration assembly in registration. Arrows with bars 112, 114 and 116, 118 are included to illustrate that print head 44 (FIG. 6) is prevented, or substantially prevented, from moving both axially and transversely with respect to the axis of rotation of platen roller 17.

Other functionalities of the label printer that can be used with the registration assembly are more fully described in a co-pending U.S. patent application entitled "Label Printer-Cutter With Mutually Exclusive Printing and Cutting Operations" filed concurrently with the present application and which is fully incorporated herein by reference.

While a particular preferred embodiment has been shown and described above, it is apparent that the teachings of this invention may be applied utilizing other hardware performing the same or equivalent functions. It is contemplated that cartridges for holding and/or supplying one or both of the ribbon and/or label media supplies can be of the "re-usable" (also called "refillable") type, but preferably are of the "disposable" type.

Methods have been described and outlined in a sequential fashion. Still, elimination, modification, rearrangement, combination, reordering, or the like, of the methods is contemplated and considered within the scope of the appending claims.

In general, while the present invention has been described in terms of preferred embodiments, it is recognized that equivalents, alternatives, and modifications, aside from those expressly stated, are possible and within the scope of the appending claims.

What is claimed is:

1. In a label printer having a cover portion frame and a base portion frame, a label printer registration assembly comprising:

a registration device securable to the base portion frame of the label printer, and a print head assembly mountable to the cover portion frame of the label printer, the print head assembly comprising:

a variably loadable print head for printing to a label media; and a registration face attached to the print head;

wherein the registration face is engageable with the registration device to maintain registration between the print head and the registration so as to substantially prevent the print head from moving both axially and transversely with respect to an axis of rotation of the registration device.

2. The registration assembly of claim 1 wherein the registration device is a registration roller.

3. The registration assembly of claim 2 wherein the registration roller is a platen roller.

4. The registration assembly of claim 3 wherein the platen roller can rotate about an axis of rotation.

5. The registration assembly of claim 4 wherein the variably loadable print head can be variably loaded to a media-specific load and wherein the registration face can engage the platen roller such that the print head is substantially prevented from moving both axially and transversely with respect to the axis of rotation about which the platen roller can rotate.

6. The registration assembly of claim 1 wherein print head assembly further comprises:

a print head lift cam connected to the cover portion frame; and print head assembly pin in operative association with the print head lift cam, the pin housing a print head load spring; and wherein the load spring housed within the print head assembly pin can be compressed via rotation of the cam so as to transfer a media-specific load to the label media.

7. The registration assembly of claim 6 wherein the print head assembly further comprises:

a print head mount connected to the print bead assembly pin; and a print head pivot pin;

wherein the print head pivot pin passes through, so as to pivotally connect, the print head assembly pin and the print head mount.

8. The registration assembly of claim 1 wherein the print head is a thermal print head.

9. The registration assembly of claim 1 wherein the registration device is a shaft.

10. In a label printer having a cover portion frame and a base portion frame, a label printer registration assembly comprising:

a registration device securable to the base portion frame of the label printer, and a print head assembly mountable to the cover portion frame of the label printer, the print head assembly comprising:

a variably loadable print head for printing to a label media; and a registration face attached to the print head;

wherein the registration face is engageable with the registration device to maintain registration between the print head and the registration device;

wherein the registration device is a registration roller;

wherein the registration roller is a platen roller; and wherein the registration face attached to the print head includes a notch and the platen roller includes a shaft portion having a groove and the registration face notch is engageable with the platen roller shaft groove.

11. The registration assembly of claim 10 wherein the registration face notch comprises a substantially U-shaped portion.

12. A label printer comprising:

a cover portion having a cover portion frame attached to the cover portion;

a base portion having a base portion frame, the base portion frame connected to the base portion and to the cover portion frame; and a dot line registration assembly comprising:

a registration roller securable to the base portion frame of the label printer, and a print head assembly mountable to the cover portion frame of the label printer, the print head assembly comprising:

a variably loadable, thermal print head for printing a dot line to a label media; and a registration face attached to the print head;

wherein the registration face is engageable with the registration roller to maintain dot line registration between the thermal print head and the registration roller so as to substantially prevent the print head from moving both axially and transverse with respect to an axis of rotation of the registration device.

13. The label printer of claim 12 wherein the registration roller is a platen roller.

14. The label printer of claim 13 wherein the platen roller can rotate about an axis of rotation.

15. The label printer of claim 14 wherein the variably loadable print head can be variably loaded to a media-specific load and wherein the registration face can engage the platen roller such that the print head is substantially prevented from moving both axially and transversely with respect to the axis of rotation about which the platen roller can rotate.

16. The label printer of claim 12 wherein print head assembly further comprises:

a print head lift cam connected to the cover portion frame; and print head assembly pin in operative association with the print head lift cam, the pin housing a print head load spring; and wherein the load spring can be compressed via rotation of the cam so as to transfer a media-specific load to the label media.

17. A label printer comprising:

a cover portion having a cover portion frame attached to the cover portion;

a base portion having a base portion frame, the base portion frame connected to the base portion and to the cover portion frame; and a dot line registration assembly comprising:

a registration device securable to the base portion frame of the label printer, and a print head assembly mountable to the cover portion frame of the label printer, the print head assembly comprising:

a variably loadable print head for printing to a label media; and a registration face attached to the print head;

wherein the registration face is engageable with the registration roller to maintain dot line registration between the thermal print head and the registration roller; and wherein the registration roller comprises a groove and the registration face comprises a notch for engaging the groove in the registration roller.

18. The label printer of claim 17 wherein the notch comprises a substantially U-shaped portion.

19. In a label printer having a cover portion with a cover portion frame attached to the cover portion and a base portion with a base portion frame attached to the base portion and the cover portion frame, a dot line registration assembly, the dot line registration assembly comprising:

a platen roller, rotatable about an axis of rotation, the platen roller having a pair of shaft portions, with each of the shaft portions having a groove formed therein, the platen roller shaft portions securable to the base portion frame of the label printer, and a print head assembly mountable to the cover portion frame of the label printer, the print head assembly comprising:

a variably loadable print head for printing a dot line to a label media, the print head variably loadable to a media-specific load; and a pair of opposing registration faces attached to the print head, the pair of opposing registration faces each having a notch formed therein; and wherein each of the registration face notches are engageable with the grooves of the platen roller shaft portions so as to maintain dot line registration by substantially preventing both axial and transverse movement of the print head with respect to the platen roller axis of rotation.

20. The dot line registration assembly of claim 19 wherein at least one of the registration face notches comprises a substantially U-shaped portion.

21. The dot line registration assembly of claim 19 wherein both of the registration face notches comprise a substantially U-shaped portion.

22. The dot line registration assembly of claim 19 wherein print head assembly further comprises:

a print head lift cam connected to the cover portion frame; and print head assembly pin in operative association with the print head lift cam, the pin housing a print head load spring; and wherein the load spring is compressed via rotation of the cam so as to transfer a media-specific load to the label media.

23. The dot line registration assembly of claim 22 wherein the print head assembly further comprises:

a print head mount connected to the print head assembly pin; and a print head pivot pin;

wherein the print head pivot pin passes through so as to pivotally connect, the print head mount assembly pin and the print head mount.

24. In a dot line registration assembly, the dot line registration assembly including: a registration roller securable to a base portion frame of a label printer; and a print head assembly mountable to a cover portion frame of the label printer, the print head assembly including: a variably loadable, thermal print head for printing the registered dot line to the label media; and registration face attached to the print head, a method of printing to a label media the method comprising:

engaging the registration face with the registration device so as to achieve and maintain dot line registration by substantially preventing the print head from moving both axially and transversely with respect to an axis of rotation of the registration roller;

loading the variably loadable print head to a label media-specific load to achieve loaded registration between the print head and the registration roller; and thermally printing, at the media-specific load, a dot line to the label media, using the print head.

25. The method of claim 24 wherein loading to a media-specific load is accomplished using values stored on a memory device in operable association with a label media supply.

26. The method of claim 24 further comprising unloading the variably loadable print head while the print head and the registration roller are engaged so as to achieve and maintain unloaded registration.

27. A method of printing to a label media, the method comprising:

providing a dot line registration assembly, the dot line registration assembly including: a registration roller securable to a base portion frame of a label printer; and a print head assembly mountable to a cover portion frame of the label printer, the print head assembly including: a variably loadable, thermal print head for printing the registered dot line to the label media; and registration face attached to the print head;

engaging the registration face with the registration device so as to achieve and maintain dot line registration;

loading the variably loadable print head to a label media-specific load to achieve loaded registration between the print head and the registration roller; and thermally printing, at the media specific load a dot line to the label media using the print head;

wherein the registration face includes a notch and the registration roller is a platen roller having a shaft portion with a groove as part of providing the dot line registration assembly.

28. The method of claim 27 wherein engaging includes engaging the registration face notch with the platen roller shaft groove.

29. The method of claim 28 further comprising substantially preventing both axial and transverse movement of the print head with respect to an axis about which the platen roller rotates.

30. The method of claim 27 wherein the registration face notch includes a substantially U-shaped portion.

31. A printing system for use in a label printer having a cover portion with a cover portion frame attached to the cover portion and a base portion with a base portion frame attached to the base portion and the cover portion frame, the printing system comprising:

a label media supply for supplying a label media;

an ink ribbon supply for supplying a thermally-sensitive ink to the label media; and a dot line registration assembly comprising:

a platen roller, rotatable about an axis of rotation, the platen roller having a pair of shaft portions, with each of the shaft portions having a groove formed therein, the platen roller shaft portions securable to the base portion frame of the label printer; and a print head assembly mountable to the cover portion frame of the label printer, the print head assembly comprising:

a variably loadable print head for printing a dot line to the label media, the print head variably loadable to a media-specific load; and a pair of opposing registration faces attached to the print head, the pair of opposing registration faces each having a notch formed therein;

wherein the ink ribbon and label media can pass in overlay relationship with each other between the print head and the platen roller; and wherein each of the registration face notches are engageable with the grooves of the platen roller shaft portions so as to maintain dot line registration by substantially preventing both axial and transverse movement of the print head with respect to the platen roller axis of rotation.

* * * * *

UNITED STATES PATENT AND TRADEMARK OFFICE

CERTIFICATE OF CORRECTION

PATENT NO. : 6,768,502 B2
DATED : July 27, 2004
INVENTOR(S) : Scott C. Milton

It is certified that error appears in the above-identified patent and that said Letters Patent is hereby corrected as shown below:

Column 6,
Line 4, insert -- grooves --after the first occurrence of "the".

Column 10,
Line 12, insert -- (not -- after "motor" and before "shown)."

Column 12,
Line 66, replace "device" with -- roller --.

Column 13,
Line 4, insert -- a dot line -- after "printing" and before "to".

Signed and Sealed this

First Day of February, 2005

JON W. DUDAS
*Director of the United States Patent and Trademark Office*